United States Patent [19]

Tomita et al.

[11] 4,072,794

[45] Feb. 7, 1978

[54] OIL ADSORBENT AND A METHOD OF PRODUCING SAME

[75] Inventors: Shigeru Tomita; Yoshindo Matsuda; Kazuki Terajima; Keiji Abe, all of Tokyo, Japan

[73] Assignee: Agency of Industrial Science and Technology of Japan, Tokyo, Japan

[21] Appl. No.: 738,438

[22] Filed: Nov. 3, 1976

[30] Foreign Application Priority Data

Dec. 19, 1975 Japan ..... 50-152071

[51] Int. Cl.[2] ..... B05D 5/04; B05D 1/38; B32E 9/04

[52] U.S. Cl. ..... 428/378; 210/40; 252/427; 427/214; 427/379; 427/382; 210/DIG. 26

[58] Field of Search ..... 427/214, 379, 382; 210/DIG. 26 P, 40; 252/427; 428/375, 378

[56] References Cited

U.S. PATENT DOCUMENTS

| | | | |
|---|---|---|---|
| 3,536,615 | 10/1970 | Bunn | 210/DIG. 26 P |
| 3,607,741 | 9/1971 | Sohnius | 210/DIG. 26 P |
| 3,630,891 | 12/1971 | Peterson et al. | 210/DIG. 26 P |

*Primary Examiner*—James R. Hoffman

[57] ABSTRACT

An oil adsorbent comprising natural fibers the surface of which is coated with a water-repellent paraffin layer which is in turn coated with an elastic rubber layer. The adsorbent is manufactured by treating the surface of the natural fibers with a paraffin emulsion, drying the fibers to form a water repellent paraffin layer thereon, treating the product with a latex, and then curing the latex to form an elastic rubber layer on the paraffin layer. The oil adsorbent has such advantages that it floats on the surface of water stably for a long period of time retaining its original form, that the contained paraffin is not back extracted by adsorbed oil and that it does not cause any trouble on burning.

10 Claims, No Drawings

OIL ADSORBENT AND A METHOD OF PRODUCING SAME

BACKGROUND OF THE INVENTION

The present invention relates to an oil adsorbent comprising natural fibers as a substrate thereof and to a method of producing same. The oil adsorbent of this invention possesses excellent oil absorbability with good working characteristics.

In oil tankers, oil bases, oil refineries, oil depots and the like, there frequently occur accidents including the inadvertent efflusion or leakage of stocked oil from these facilities to the surface of nearby sea or rivers. Oil adsorbents are used to adsorb and remove oil floating on the surface of the water by such accidents. In the past, oil adsorbents utilized plastics such as polypropylene, polyurethane foam and polystyrene as substrate. On burning of such plastic products after use, however, there arise various troubles, particularly in that such plastic products are difficult to ignite, and a melt of the plastic products tends to clog the passages of a furnace and the extremely high temperature generated on ignition causes damage to a furnace. Thus, disposal of such plastic products by burning requires an expensive special furnace. Further, oil adsorbents composed of atactic polypropylene or polystyrene are soluble in oil and have the disadvantage that they are swollen by absorption of oil and broken into crumbles. In practical use, therefore, a portion of the adsorbent is broken into crumbles which will scatter in the water as small pieces to be left in the water unrecovered. The oil-containing small pieces of plastics left in the water cause serious damage to aquatic resources such as fish and crustaceans.

As the known conventional plastic oil adsorbents thus incur various troubles when burnt after use, there is a great demand in recent years for development of an oil adsorbent devoid of such troubles. For this purpose, the use of natural substances as such for adsorbent is proposed instead of using harmful synthetic products. However, such natural subsances have some drawbacks in that they possess a water absorbing property and thus become submerged on actual use after a relatively short period of time, thus making themselves unsuited for practical use. In the above situations, there is still a great demand for development of a new type of oil absorbent which can overcome all of the above drawbacks in practical use.

BRIEF SUMMARY OF THE INVENTION

It is a primary object of the present invention to provide an oil adsorbent which incurs no trouble on disposal by burning.

It is another object of the present invention to provide a highly wave-resistant oil adsorbent comprised of natural fibers as substrate which can float on the surface of the water stably for a long period of time, retaining its original form.

It is still another object of the present invention to provide an industrially advantageous method of producing such oil adsorbents.

These and other objects, features and advantages of the present invention will become clearer from the following detailed description thereof.

DETAILED DESCRIPTION OF THE INVENTION

In accordance with the present invention, there is provided an oil adsorbent comprising natural fibers the surface of which has been coated with a water repellent paraffin layer which has in turn been coated with an elastic rubber layer.

The natural fibers chiefly used in the present invention are, for example, grass peat fibers, coconut husk fibers and jute fibers. Besides these, plant fibers such as cotton fibers or grazing grass fibers as well as animal fibers such as wool fibers or waste animal hair from leather factories may also be used. The size of the fibers used for the oil adsorbents exerts a significant influence on the oil absorbability. Generally, fibers of 10–20 deniers are suitable for light oils, while those of more than 80 deniers are suitable for heavy oils. For treating ordinary oil effluents, the use of fibers of 15–100 deniers in size is suitable. The use of longer fibers is desirable for shaping the adsorbent base. Among the above-mentioned natural fibers, therefore, grass peat fibers, coconut husk fibers and jute fibers are the most desirable. These fibers are 1.2–1.6 in specific gravity, 0.05–0.12 mm in thickness and 10–40 cm in fiber length, especially 100–200 cm in the case of jute fibers. Therefore, these fibers can be used in commercially available forms or directly as collected on the farm. Naturally, it is also possible to mix these natural fibers with one another or to add a small amount, for example, 10–20% by weight of synthetic fibers to these natural fibers.

In the first step for producing the oil adsorbent of the present invention, the natural fibers are surface treated with a paraffin emulsion and dried. The treatment with a paraffin emulsion is performed by either dipping the fibers in the paraffin emulsion or spraying the paraffin emulsion on the fibers. A paraffin having a melting point within the range of 46°–90° C, preferably 55°–65° C is used for this purpose. Using water as a medium, the emulsion of paraffin is prepared to have a paraffin concentration of 1–10% by weight, preferably 2–5% by weight. The fibers treated with the paraffin emulsion are dried at a temperature between ordinary temperature and 150° C, preferably between 70° C and 90° C. In this manner, the surface of the fibers is coated with a layer of paraffin in an amount of 0.02–0.1 g per gram of fibers.

In the second step for producing the oil adsorbent, the paraffin-coated fibers are treated with a latex and then cured. By this treatment, the paraffin layer is overlaid with a soft and elastic rubber layer. The paraffin layer is protected by this rubber layer and prevented from detaching from the fibers on actual use. Generally, the fibers are shaped into various appropriate forms such as lump, mat and belt before they are treated with the latex, but this is a matter of choice and they may be shaped into an appropriate form after they have been treated with the latex in the dispersed state.

In principle, any known conventional latex may be used for the present invention, but it is desirable from the practical point of view to use a latex capable of being cured under mild conditions so that the fibers may not be damaged during the curing treatment.

In order to avoid evolution of bad odor or toxic gases during the burning treatment of the used oil adsorbent, it is desirable to use a latex which needs no vulcanizing agent for curing. Preferable examples of the latex used in the present invention include latices of styrene-butadiene rubber (SBR), acrylonitrile-butadiene rubber (NBR) and methyl methacrylate-butadiene rubber (MBR), more preferably the so-called carboxyl-modified latices formed by copolymerizing the above mentioned rubber with 1–10% by weight of an unsaturated carboxylic acid such as acrylic acid, methacrylic acid, itaconic acid, crotonic acid or maleic acid. If necessary, these latices may be incorporated with about 10–40% by weight of a hydrocarbon rubber such as butadiene rubber (BR) or isoprene rubber. The concentration of a rubber in the latex is generally within the range of 0.1–5% by weight, preferably 0.5–2% by weight. The curing temperature is generally within the range of 100°–200° C, preferably 120°–150° C, and the curing time is within the range of 1–30 minutes, preferably 5–10 minutes. The amount of rubber attached to the fibers is within the range of 0.001–0.05 g, usually 0.005–0.01 g per gram of fibers.

For the production of commercially advantageous oil adsorbents from natural fibers in the present invention, it is necessary to coat the surface of the natural fibers with a paraffin layer which is then overcoated with a rubber layer as has been described heretofore. If the fibers are coated with a paraffin layer alone, the layer will easily become detached from the fibers by external force and the fibers will become submerged within at most about 30 hours when allowed to float on the surface of water with turbulent waves. Contrary to this, the fibers coated with a paraffin layer overlaid with a rubber layer showed good wave resistance equivalent to that of polypropylene oil adsorbents. In addition, the paraffin layer was not detached from the fibers on practical use and the fibers could be kept afloat on the surface of the water even after a lapse of more than 78 hours, retaining their original shape. The oil adsorbing capacity of the fibers shows a tendency to increase by overcoating the paraffin layer with a rubber layer.

The natural fibers subjected to a combination treatment with paraffin and then with a latex according to this invention are used as oil adsorbents in an appropriate form such as mat, belt or lump. To maintain the form firmly, the fibers are shaped into a desired form after the treatment with paraffin and then sprayed with an emulsion type adhesive or latex to effect fixing of the fibers in a network structure. If necessary, the entire surface of the oil adsorbent may be covered with a net for further reinforcement.

This invention will now be understood more readily with reference to the following examples; however, these examples are intended to merely illustrate the invention and are not to be construed as limiting the scope of the invention except as defined in the appended claims.

EXAMPLE 1

Grass peat buried in swamps in the cold areas at lat. 40° N or higher was separated into fibrous parts and humus. The fibrous parts were dehydrated, dried, beaten, loosened and selected after drying the treated fibrous parts to have a moisture content of about 20% whereby long fibers (10–40 cm in fiber length) alone were collected. One hundred grams of the grass peat fibers thus selected were dipped into an appropriate diluted paraffin emulsion with the following properties to impregnate the fibers sufficiently with the paraffin, taken up from the emulsion and dried at 80° C.

Properties of the paraffin emulsion

Appearance: milky white liquid
Emulsifying agent: a non-ionic surfactant
Solid matter: 50%
Melting point of the solid matter: 130° F
pH: 7–8

The fibers treated with the paraffin emulsion in this manner were then treated with a latex or a snythetic rubber. The latex used in this case was a combination of MBR latex containing methyl methacrylate-butadiene copolymer and C-MBR latex containing the copolymer modified with an unsaturated carboxylic acid and had a solid matter concentration of 47.5% and a pH of 5–8. The treatment with the latex was carried out by dipping the grass peat fibers into an appropriately diluted dispersion of the latex, preliminarily drying the impregnated fibers at 80°–100° C and then subjecting them to a heat treatment conducted at 130°–140° C for a few minutes to effect the curing of the latex.

The fibers thus treated were tested in the following manner: One gram of the sample weighed accurately was placed in a conical beaker of one liter capacity containing 400 ml of water and was shaken for 6 hours with about 100 reciprocating motions per minute and an amplitude of 3 cm. After shaking, the fibers were placed on a steel mesh of 10 mesh for 5 minutes to drain away excess water and weighed to calculate the amount of water absorbed.

The equal amount of the fibers was floated for 5 minutes on B heavy oil having a specific gravity of 0.90–0.91 at 15° C and treated for 5 minutes in the same manner as described above to drain away the heavy oil whereby the amount of the adsorbed oil was calculated. A similar test was made for the fibers treated with the paraffin emulsion and the latex each having various different concentrations. A result of the tests is shown in Table 1.

The result in the Table indicates that the doubly treated fibers with the paraffin and the latex are superior in water-repellent property than those treated with the paraffin alone. This is because the treatment with the latex serves to stabilize the form of the fibers and to prevent isolation of the paraffin as Table 1

| | Water-repelling treatment with the Paraffin-latex system | | | |
|---|---|---|---|---|
| | Concentration (%) | | Rate of adsorption | Amount of oil |
| latex | Paraffin emulsion | Latex | of water (%) | adsorbed (g/g) |
| MBR | — | — | 460 | 15.8 |
| | 0 | 0.5 | 162 | 15.4 |
| | 2 | 0.5 | 82 | 16.1 |
| | 4 | — | 51 | 13.9 |
| | 4 | 0.5 | 45 | 16.6 |
| | (4*) | (0.5*) | (63) | (14.7) |
| C-MBR | — | 0.5 | 114 | 16.3 |
| | 2 | 0.1 | 47 | 15.9 |
| | 2 | 0.5 | 44 | 16.1 |
| | 2 | 1.0 | 45 | 15.4 |
| | 2 | 2.0 | 43 | 14.4 |
| | 4 | — | 51 | 13.9 |
| | 4 | 0.5 | 46 | 15.5 |
| | 4 | 1.0 | | 14.6 |
| | 4 | 2.0 | 31 | 14.0 |
| | (4*) | (0.5*) | (57) | (14.7) |

*Treated with the paraffin after coating the fibers with the latex demonstrated by the effect that the fibers were not loosened even after shaking for 6 hours. The oil adsorbing property of the doubly treated fibers is more improved than that of the fibers treated with the paraffin alone. It is understood that the treatment with only 0.5–2% of the latex greatly improves the efficiency as oil adsorbent. If the treatment with the paraffin and the treatment with the latex were performed in the reverse order of succession, both the water-repellent property and the oil adsorbent property would be inferior as shown in Table 1.

A result of the test made with coconut husk fibers in the same manner as described above is shown in Table 2.

Table 2

| Water-repelling treatment of coconut husk fibers | | | |
|---|---|---|---|
| Concentration (%) | | Amount of oil adsorbed (g/g) | Amount of water adsorbed (g/g) |
| Paraffin | C-MBR latex | | |
| — | — | 2.6 | 3.6 |
| 4 | — | 2.3 | 2.2 |
| 4 | 0.5 | 2.9 | 1.8 |

The above data show that the water-repellent property and the oil-adsorbing property of the coconut husk fibers are markedly improved by the paraffin-latex treatments.

EXAMPLE 2

Grass peat fibers rendered water repellent by the treatment with the paraffin emulsion described in Example 1 were shaped into a desired form such as mat, lump or belt and reinforced, if necessary, by netting or needle-punching. An appropriately diluted latex of synthetic rubber was sprayed over the shaped grass peat fibers and the latex was cured according to the method described in Example 1 to obtain the end product.

EXAMPLE 3

An oil adsorbing mat comprising grass peat fibers produced according to the method described in Example 2 (450 × 450 × 10 mm in size, covered with a rayon net) was subjected to a submergence test on the calm and turbulent water surface.

The amount of paraffin and the weight percentage of the synthetic rubber per unit weight of the grass peat fibers are shown in Table 3.

When the mat described above was placed on the calm surface of water and allowed to float thereon for 360 hours, the mat did not submerge. When the amount of water adsorbed was measured after the mat was pulled up, the amount was 370 g/100 g of mat for mat A and 106 g/100 g of mat for mat B.

Table 3

| Mat No. | Paraffin (%) | Rubber (%) | latex used |
|---|---|---|---|
| A | — | — | — |
| B | 4 | — | — |
| C | 4 | 0.5 | MBR |
| D | 2 | 0.5 | MBR |
| E | 2 | 0.5 | carboxyl modified MBR |
| F | 2 | 0.1 | " |
| G | 4 | 0.5 | " |

Further, a similar submergence test of the mat was performed on the turbulent surface of water. The test on the turbulent surface of water was performed in a large wave-making tank equipped with a wave-extinguishing apparatus. Adjusting the wave-making condition to obtain a wave height of 25–30 cm, a wave length of 200 cm and a wave cycle of 1.2 seconds, a floating wave-resistance test for 6 hours and a floating test in stationary state for 18 hours were repeated 3 times. A result of these tests is shown in Table 4 below.

Among the commercially available oil adsorbents tested simultaneously, a cellulose oil adsorbent became submerged after 23 hours, a polyurethane oil adsorbent became submerged after 72 hours and a polypropylene oil adsorbent became submerged after 78 hours in a ratio of ¼ - 1/10.

Table 4

| Mat No. | Time to complete submergence (Hr) | Time to finish of the test (Hr) | Ratio of submergence of the maps tested |
|---|---|---|---|
| A | 28 | | |
| B | 30 | | |
| C | | 78 | about 9/10 |
| D | 75 | | |
| E | | 78 | about 3/4 |
| F | | 78 | about 1/2 |
| G | | 78 | about 1/10 |

The above data indicate that the mat G produced according to the method of the present invention, i.e. a mat made of grass peat fibers for which 4% of paraffin and 0.5% of a carboxyl modified MBR have been used, has a floatability of at least 78 hours as a result of wave resistance test and that the mat is equivalent in floatability and wave resistance to a commercially available polypropylene mat.

EXAMPLE 4

An oil adsorbent designated as mat G in Example 3 and produced from grass peat fibers according to the method described in Example 2 was subjected to the tests A and B stipulated in Article 33-2, Par. 2, No. 3 of the Marine Pollution Inhibition Law Enforcement Rules (enforced since July 13th 1974) in accordance with the method remarked in the Annexed Notes of the above Enforcement Rules. A result of the tests for the amounts of water and oil adsorbed was as shown in Table 5.

Table 5

1. Apparent specific gravity: 0.08 g/cm$^3$
2. Amount of water adsorbed 0.50 g/g (0.05 g/cm$^3$)
3. Amount of oil adsorbed:

| Type of oil | Light oil | Heavy oil A | Heavy oil B | Heavy oil C | High viscosity oil |
|---|---|---|---|---|---|
| Viscosity of oil | 4.9 cp | 5.0 cp | 6.75 cp | 735.0 cp | 7,100 cp |
| Amount of oil adsorbed g/g | 8.2 | 8.5 | 9.5 | 9.9 | 10.0 |
| g/cm$^3$ | 0.7 | 0.75 | 0.8 | 0.85 | 0.95 |

Testing method (Par. 2, No. 3 of the Rules) :

The tests were performed in accordance with Art. 33-2 of the Marine Pollution Inhibition Law Enforcement Rules. In the case of the high viscosity oil, however, the measurement was made after a lapse of 5 minutes from dipping.

4. combustibility:

| Material | Ignition | Burning | Remarks |
|---|---|---|---|
| Original material | Easy | Burnt well | No black smoke evolved |
| Oil-adsorbed material | Easy | Burnt well | Burnt in oil-containing state |

5. Floatability:
Not submerged, retaining the original form
Measuring condition: The sample was floated on the surface of sea water or water and tested for 120 hours.

6. Wave resistance:

-continued

| | |
|---|---|
| Not submerged, retaining the original form | |
| Measuring condition: | A floating wave resistance test wherein the sample is allowed to float on the surface of water with waves of 25–30 cm in wave height, 200 cm in wave length and 1.2 seconds in cycle for 6 hours and a floating test in stationary state wherein the sample is allowed to float on the calm surface of water for 18 hours were repeated 3 times for 72 hours in all. |
| 7. Oil resistance: | |
| Not dissolved nor swollen, retaining the original form | |
| Measuring condition: | The sample was dipped into toluene and gasoline and tested for 120 hours. |

Obviously, many modifications and variations of the present invention are possible in the light of the above teachings. It is to be understood that this invention is not limited to the specific embodiments thereof except as defined in the appended claims.

What is claimed is:

1. An oil adsorbent which comprises natural fibers selected from the group consisting of vegetable fibers and animal fibers which fibers are precoated with a water repellent paraffin layer and subsequently coated with an elastic rubber layer.

2. The oil adsorbent according to claim 1 wherein said vegetable fibers are selected from the group consisting of grass peat fibers, coconut husk fibers jute fibers and mixtures thereof.

3. The oil adsorbent according to claim 1 wherein said elastic rubber layer is derived from a latex.

4. The oil adsorbent according to claim 3 wherein said latex contains at least one rubber selected from the group consisting of styrene-butadiene rubber, acrylonitrile-butadiene rubber, methyl methacrylate-butadiene rubber and a rubber copolymerized with an unsaturated carboxylic acid.

5. The oil adsorbent according to claim 4 wherein said latex contains a hydrocarbon rubber.

6. A method of producing an oil adsorbent which comprises treating natural fibers selected from the group consisting of vegetable fibers and animal fibers with a paraffin emulsion, drying the so treated fibers to form a paraffin layer thereon, treating the resulting coated fibers with a latex and then curing said latex to coat said paraffin layer with a rubber layer.

7. The method according to claim 6 wherein said vegetable fibers are selected from the group consisting of grass peat fibers, coconut husk fibers jute fibers and mixtures thereof.

8. The method according to claim 6 wherein said latex contains at least one rubber selected from the group consisting of styrene-butadiene rubber, acrylonitrile-butadiene rubber, methyl methacrylate-butadiene rubber and a rubber copolymerized with an unsaturated carboxylic acid.

9. The method according to claim 8 wherein said latex contains a hydrocarbon rubber.

10. The method according to claim 6 wherein the temperature for said drying is between ordinary temperature and 150° C and the temperature for said curing is between 100° C and 200° C.

* * * * *